US006135629A

United States Patent [19]

Dohmann

[11] Patent Number: 6,135,629

[45] Date of Patent: Oct. 24, 2000

[54] DEVICE FOR STIRRING UP GAS FLOWING THROUGH A DUCT HAVING A STRUCTURAL INSERT POSITIONED AT AN ACUTE ANGLE TO A MAIN GAS STREAM

[75] Inventor: Joachim Dohmann, Oberhausen, Germany

[73] Assignee: Deutsche Babcock Anlagen GmbH, Oberhausen, Germany

[21] Appl. No.: 09/231,430

[22] Filed: Jan. 14, 1999

[30] Foreign Application Priority Data

May 11, 1998 [DE] Germany ..... 198 20 992

[51] Int. Cl.[7] ..... B01F 5/00

[52] U.S. Cl. ..... 366/181.5; 366/337

[58] Field of Search ..... 366/181.5, 336, 366/337, 340; 48/189.4; 138/37, 39

[56] References Cited

U.S. PATENT DOCUMENTS

| | | | |
|---|---|---|---|
| 1,454,196 | 5/1923 | Trood . | |
| 1,466,006 | 8/1923 | Trood . | |
| 3,557,830 | 1/1971 | Raw . | |
| 4,164,375 | 8/1979 | Allen | 366/337 |
| 4,718,393 | 1/1988 | Bakish | 48/189.4 |
| 5,456,533 | 10/1995 | Streiff et al. | 366/337 |
| 5,489,153 | 2/1996 | Berner et al. | 366/337 |
| 5,518,311 | 5/1996 | Althaus et al. | 366/181.5 |
| 5,803,602 | 9/1998 | Eroglu et al. | 138/37 |
| 5,967,658 | 10/1999 | Mohajer | 366/337 |

FOREIGN PATENT DOCUMENTS

| | | | |
|---|---|---|---|
| 619134 | 10/1994 | European Pat. Off. | 366/337 |

*Primary Examiner*—Charles E. Cooley
*Attorney, Agent, or Firm*—Max Fogiel

[57] ABSTRACT

A device for stirring up gas flowing through a duct (2) accommodating one or more flat insertion structures (1) positioned at an acute angle to the main gas stream. Each structure constitutes an eddy-generating surface with a freely washed forward edge directed toward the oncoming gas and facing partly along and partly across the flowing gas. Each structure can be contoured in cross-section. The object is to decrease the weight of the structures. Each structure is accordingly basically a trapezium with two parallel edges of different length, the shorter edge of the installed structure facing upstream and the longer edge provided with an aerodynamic sweep and facing downstream. The structure is also accordingly folded along three straight lines (3) to form an ω or w in cross-section, with two convex folds (5) flanking a single concave fold (4).

20 Claims, 4 Drawing Sheets

DEVICE FOR STIRRING UP GAS FLOWING THROUGH A DUCT HAVING A STRUCTURAL INSERT POSITIONED AT AN ACUTE ANGLE TO A MAIN GAS STREAM

BACKGROUND OF THE INVENTION

The present invention concerns, first, a device for stirring up gas flowing through a duct and, second, a method of using the device.

Devices for stirring up flowing gas are needed for processing the flue gases that occur when coal, refuse, sludge, and other materials are burned. Such gases contain certain undesirable but unavoidable pollutants, which are removed in downstream scrubbers. Among these pollutants are nitrogen oxides, which can be reduced by adding a reduction agent to the gas.

The oxide-reduction agent in some known versions of the method are mixtures of ammonia and water, added in the form of a mist to gas through pneumatic nozzles. The mist evaporates rapidly in the high heat, and the liquid phase converts to a gas phase. The accordingly enriched gas is forwarded to a catalyzer, where the oxides are broken down. Success here demands matching the concentrations of each reaction partner. If too little reduction agent is added at a particular point, the oxides will decompose incompletely. This is unsatisfactory when the amounts of emissions over time are to be kept low. The addition of too much reduction agent at a particular point on the other hand will generally leave too much of it in the gas, leading to impermissible emissions of that material. The method can only be carried out satisfactorily when the gas is thoroughly mixed with the oxide-reduction agent. The elimination of local temperature differences that derive from irregular loads on the heat exchanger or from the operation of a burner integrated into the duct is also to be recommended. Since the rate of reaction is temperature-dependent, local irregularities in the mean gas-temperature curve over time will limit how much material the reactor can actually separate while reducing the oxides. Variations in temperature over time, however, will be compensated to some extent by the thermally inert mass of the catalyzer material.

Local differences in concentration and temperature are eliminated at the state of the art with static mixers. Introducing the oxide-reduction agent through intersecting-pipe gratings installed in the reduction agent into the path of the gas are known. These registers, or distributors, have many sites for the agent to emerge from. The gas is blended with the agent by turbulence downstream of the pipes. How thoroughly the substances are combined is technically limited by the number of pipes. Furthermore, a reduction-agent introduction grating of intersecting pipes entails a considerable and undesirable loss of pressure.

Satisfactory mixture can also be achieved by rotating some components of the main stream, with the axis of rotation extending along the main axis of flow. A known static mixer accommodates a mixing structure in the form of a surface coiled around the main stream axis and accordingly curved. A series of such structures will ensure a satisfactory mixture. There are drawbacks to this approach, however. Their curvature complicates the design and takes up space. Furthermore, each structure extends all the way across the path of the gas.

Another mixer of this genus employs a structure that exploits the wake deriving from agitation plates mounted against the wall of the duct. These plates are approximately trapezoidal, with their base secured to the wall. The three exposed edges are washed all around by the gas. The structures slope along the main direction of flow and are secured by webs in the constriction between them and the wall, where the flow is released, that is. The structures generate two opposing eddies with velocity components normal to the main direction of flow. The paired eddies intensify the mixture in the gas phase. Using several such structures is supposed to ensure satisfactory mixture. A drawback is the relatively long edges of the structures resting against the wall of the duct.

Other static mixers are described in German A 4 123 161. Here, one cross-section of the duct is divided into several rectangular fields, each accommodating a trapezoidal baffle that slopes toward the main direction of flow.

A generic device that mixes several streams of gas together or adds a liquid coolant to a flowing gas is known from German C 2 911 873, German U 8 219 268, and European Patent 0 673 726. This device employs flat insertion structures in the form of symmetrical surfaces. Their edges are washed free on all sides by the fluids being combined. The structures slope at an acute angle into the flowing gas such as to generate a detachment eddy, which the documents call a forward-edge eddy, at the forward edge. This eddy also includes velocity components at an angle to the main stream, intensifying the mixing process. The structures in this known device are circular, elliptical, oval, parabolic, rhomboidal, or triangular. They can be contoured in cross-section or have bent edges or a V-shaped cross-section.

There are drawbacks to this genus of static mixers. The free all-around washing of the structures' edges necessitates a separate support (cf. German U 8 219 268). The shape of the structures allows the flowing gas to induce non-stationary forces that express themselves as vibrations. The supports that secure the structures must be designed to accommodate the mechanical stress occasioned by the vibrations. The supports usually have to be large, with high moments of resistance. The weight of the supports is a serious drawback in that the technology usually requires them to be positioned high enough up inside the reactor to reduce the oxides. This requirement in turn is detrimental to the static design and assembly of the overall reactor.

SUMMARY OF THE INVENTION

The object of the present invention is accordingly to improve the generic device by decreasing the weight of the structures and supports.

The structures in accordance with the present invention generate a train of eddies with flow components at an angle to the main stream, stirring up the flowing gas more thoroughly. Since the structures are folded along straight lines to create reinforcing ω or w cross-sections, they can be thinner and accordingly lighter in weight. The ω or w cross-sections also allow the insertion of braces or noded sheets to further decrease weight and increase mechanical stability. Since these reinforcements can be applied to the downstream surface, they will not interrupt the flow of gas. The supports that secure the structures can also be accommodated in the duct inside the concave fold along the midline on the upstream surface of the structures. The supports will accordingly, in contrast to the state of the art, be outside the eddy fields, which will not be detrimentally affected, and the supports can be lighter in weight.

BRIEF DESCRIPTION OF THE DRAWINGS

Various embodiments of the present invention will now be specified with reference to the accompanying drawing, wherein.

DESCRIPTION OF THE PREFERRED EMBODIMENTS

The device for stirring up flowing gas in accordance with the present invention employs flat insertion structures 1. Their position and function within a duct 2 will be specified hereinafter.

Figure 1:
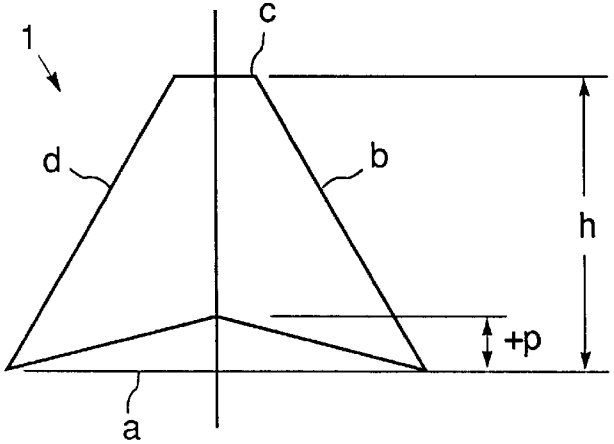
FIG. 1 is a top view of an inserted structure.
Figure 2:
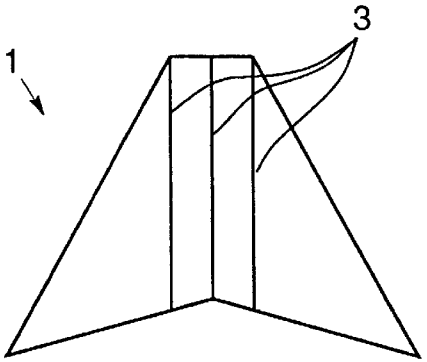
FIG. 2 is a top view of the structure illustrated in FIG. 1 showing the straight bends.

The geometry of a structure 1 will now be initially specified with reference to FIGS. 1 and 2. Its basic shape is conceptually a flat trapezium, symmetric in the illustrated example, although it could alternatively be asymmetric. The trapezium derives from straight bends in the edges of the conceptually flat structure. The trapezium has sides a, b, c, and d and an altitude h.

Sides a and c are parallel, the longer side a constituting the base of the trapezium. An aerodynamic sweep has been notched out of the only conceptually straight base a of the structure illustrated in FIG. 1 to a depth +p.

Figure 4:
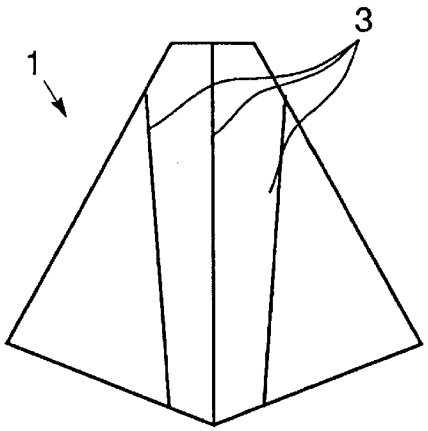
FIG. 4 is a top view of another type of structure in place.

The sweep helps decrease weight, optimizes the distance between the rear edge of the installed structure and the associated wall of the duct, and diminishes non-stationary components of the gas's motion. Such a sweep can alternatively be in the form of a projection, in which event its altitude will be negative, and the structure will be in the shape of a kite with a truncated fold as illustrated in FIG. 4. The particular altitude of the sweep depends on the overall altitude h of the conceptual trapezium. The absolute dimension of the ratio between altitudes p and h will range from 0.1 to 0.75, or, expressed mathematically, $0.1<(p/h)<0.75$.

Inserted structure 1 is installed in a duct 2 with gas flowing through it with shorter side c upstream. Side c accordingly represents the upper edge of the structure, sides b and d its lateral edges, and the swept-out side its lower edge.

Since the axis of gravity of each structure 1 slopes at an angle to the main stream of gas, the structure will have a bottom facing upstream and a top facing downstream. The axis of gravity can also be rotated around the main stream at an angle. If structure 1 is symmetric in this event, the gas will encounter it asymmetrically.

Each structure 1 is reinforced by bending it along three straight lines 3. The middle line, the major axis, that is, coincides, before the structure is folded, with the structure's axis of gravity. As will be evident from FIG. 2, straight lines 3 can be parallel and extend from the upper edge to the lower edge. Alternatively, the two outer lines can slope together toward the rear edge as illustrated in FIG. 4, the middle line bisecting the angle of slope. The lines in this version will extend from the lateral edges to the lower edge.

Figure 3:
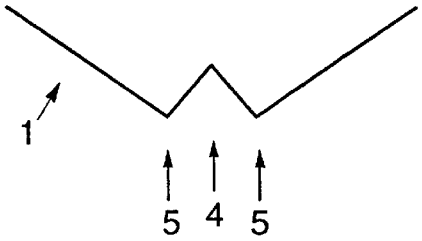
FIG. 3 is a front view of the structure illustrated in FIG. 2.

As will be evident from FIG. 3, the originally flat structure has been folded along straight lines 3 to create a cross-section in the form of an ω or w. The accordingly folded structure 1 is introduced into the flowing gas with an upstream-concave fold 4 along the midline flanked by a convex fold 5 on each side.

The folding produces four surfaces that abut at straight lines 3. The two inner surfaces are to each side of upstream-concave fold 4. The convex folds 5 are each flanked by one inner surface and one inner surface. The two outer surfaces meet at a mutual angle of approximately 120° and the inner surfaces at an angle of approximately 90°. The angle between the two outer surfaces can range from 90° to 180° and the angle between the two inner surfaces from 0° to 120°.

Figure 6:
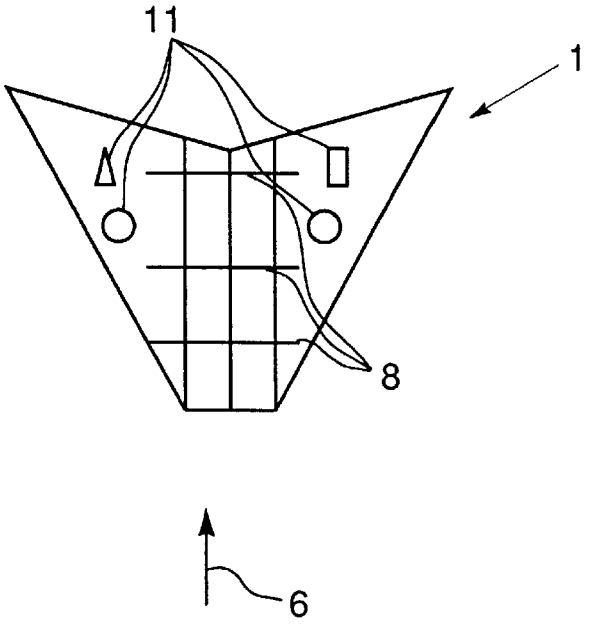
FIG. 6 is a view perpendicular to the side view in FIG. 5.
Figure 5:
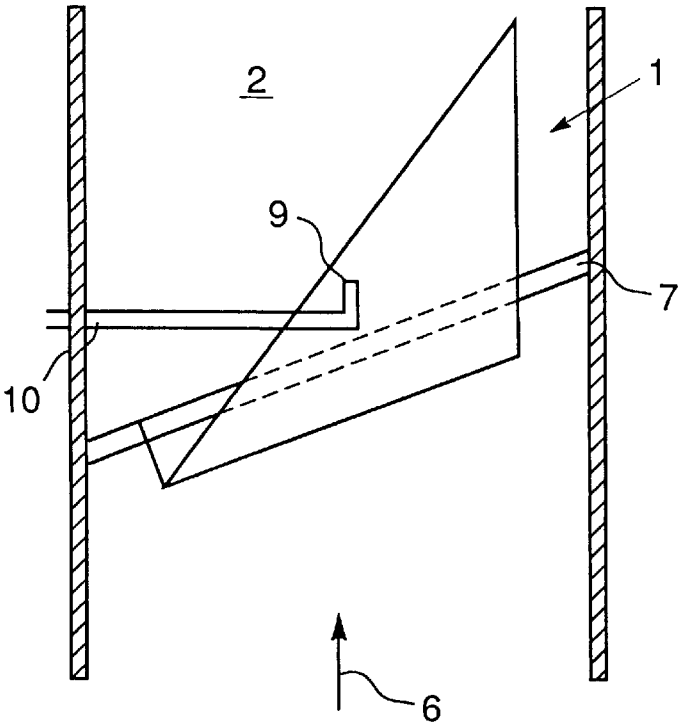
FIG. 5 is a side view of a structure installed in a duct.

FIGS. 5 and 6 illustrate an insertion structure installed in a duct 2 that has flue gas deriving from a combustion process flowing through it. It will be evident that the major axis of structure 1 extends at an angle to the direction 6 of the main gas flow. In this situation, the structure's upper and lateral edges face the oncoming gas. The lower edge, as will be evident from FIG. 5, extends downstream and parallels one wall of duct 2. The lower edge can alternatively slope at an acute angle to the wall.

Structure 1 is secured to a support 7 that rests against two opposing walls of duct 2. Support 7 is accommodated against the bottom of structure 1, which is upstream, inside concave fold 4. In this position, support 7 cannot detrimentally affect the field of gas flowing along the edge.

Mounted on the top of structure 1 and within the two outer and upstream-convex folds 5 are braces 8 or noded sheets. Each brace 8 connects two legs of the ω, augmenting the structure's mechanical stability. Since braces 8 are mounted against the downstream side of structure 1, they will not deleteriously affect the flow of gas.

The upper and lateral edges of structure 1 are washed all around by the flowing gas, resulting in detachment eddies at those edges. The eddies expand downstream in the form of a circular cone and create an eddy field. The rotation of the field generates a flow component at an angle to the main stream. These transverse components, in conjunction with their associated cross-stream exchange of momentum, help to stir up the flowing gas.

The beneficial contribution of structure 1 to thoroughly stirring up the gas can be exploited to advantage to introduce a reduction agent into the gas to reduce the nitrogen oxides present therein. The reduction agent is an atomized mixture of ammonia and water pumped into the gas through a lance 10. Lance 10 is provided with an outlet 9 and positioned in duct 2 with the head in the lee left by structure 1. The gas in the lee combines with the main stream of flue gas, resulting in a very uniform distribution of the reduction agent throughout. Locally inadequate or excess concentrations of reduction agent and temperature differences will accordingly be prevented.

Thorough stirring can be promoted by perforations 11 or holes through structures 1. A little of the flue gas will flow through perforations 11 from the structures, upstream side. The perforations can be simple cutouts in the metal sheet the structures are made of. Extra turbulence can be generated to advantage, however, by slitting the metal and bending it out. If two slits are introduced at an angle and join at a point, a triangle can be bent out of the metal. The triangle will act as a detachment edge for the flue gas flowing through the perforation. The component stream will be activated by the resulting turbulence. The flue gas and reduction agent lingering in the lee will be turbulently combined with the flue gas flowing through perforations 11. Each eddy will b e approximately as wide as its associated perforation. The eddies will accordingly always be smaller than the largest eddy component produced by the structure itself. The advantage of this approach is that the reduction agent will initially be introduced in eddies of average dimension. Only then will the average-size eddies turbulently combine with the largest eddies. The mixture lengths will be shorter on the whole. FIG. 6 illustrates perforations 11 of various shapes through a single structure 1. Ordinarily, all the perforations through a single structure will be the same shape.

Figure 7:
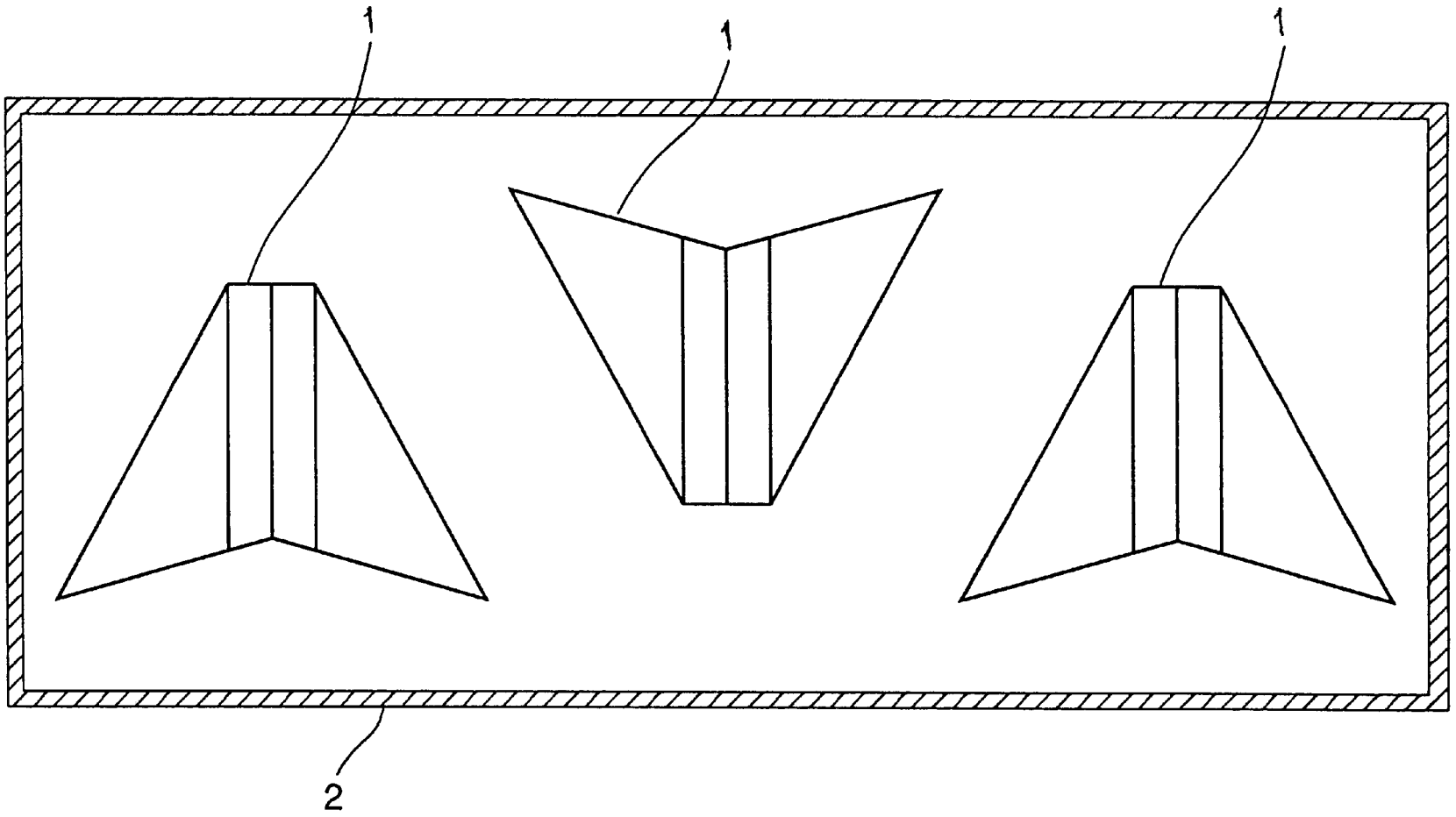
FIG. 7 illustrates a group of inserted structures.

Only one structure 1 is illustrated in the duct 2 in FIGS. 5 and 6. It can, however, be of advantage to install several such structures at approximately the same level in the duct as illustrated in FIG. 7. Various distributions are possible. Structures 1 can for example be distributed at approximately the same level oriented along the main stream. The structure can alternatively be distributed along one or more levels at an angle to the main stream, resulting in a staggered arrangement. Such an arrangement can in particular help decrease impedance and gas-end pressure loss, further counteracting the device's overall impedance.

Figure 8A:
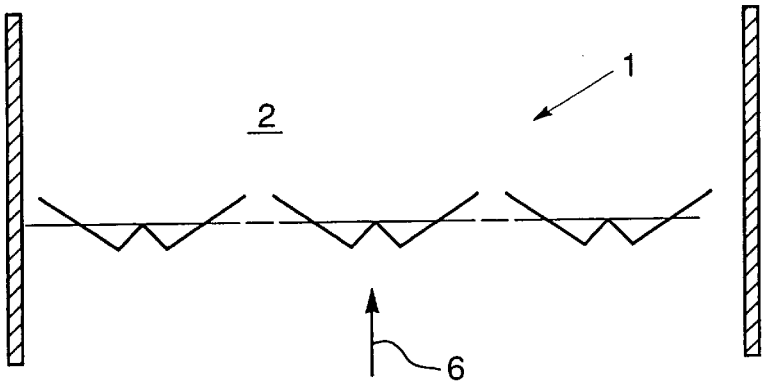
FIGS. 8*a*, 8*b*, and 8*c* show three further embodiments of the present invention.

In FIG. 8*a*, the dash-dot line designates the plane in which the installed elements are located. This plane runs perpendicular to the flow direction of the gas stream.

Figure 8B:
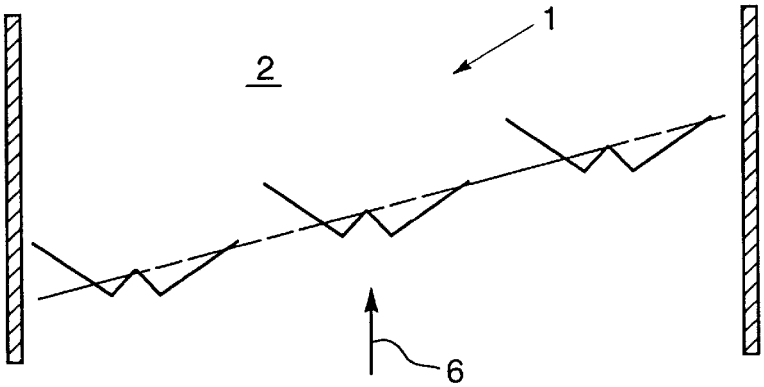

In FIG. 8*b* the aforementioned plane runs inclined to the flow direction of the gas stream.

Figure 8C:
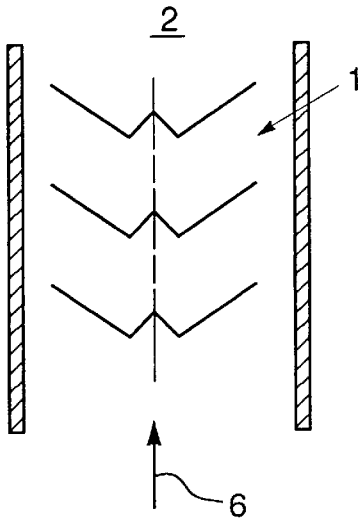

In FIG. 8*c* the aforementioned plane runs in the flow direction of the gas stream.

The invention claimed is:

1. An arrangement for stirring up gas flowing through a duct having at least one flat insertion structure positioned at an acute angle to a main gas stream, said structure comprising an eddy-generating surface with a freely washed forward edge directed toward oncoming gas and facing partly along and partly across the flowing gas; said structure being contoured in cross-section; said structure being substantially a trapezium with two parallel edges of different length, one of said parallel edges being a shorter edge and the other one of said parallel edges being a longer edge; said shorter edge of said structure facing upstream and said longer edge having an aerodynamic sweep and facing downstream; said structure being folded along three straight lines to form an ω or w in cross-section with two convex folds flanking a single concave fold.

2. An arrangement as defined in claim 1, wherein said three straight lines extend from said shorter edge to said sweep in the longer downstream edge, said shorter edge being gas-washed.

3. An arrangement as defined in claim 1, wherein said three lines that said structure is folded along are all parallel.

4. An arrangement as defined in claim 1, wherein the folds have outer surfaces sloping together at an angle of 90 to 180 degrees.

5. An arrangement as defined in claim 4, wherein said angle is 120 degrees.

6. An arrangement as defined in claim 1, wherein the folds have inner surfaces sloping together at an angle of 0 to 90 degrees.

7. An arrangement as defined in claim 6, wherein said angle is 90 degrees.

8. An arrangement as defined in claim 1, wherein said sweep has a depth and said trapezium has a height, a ratio of said depth to said height being in a range of 0.1 to 0.75.

9. An arrangement as defined in claim 1, wherein said structure has perforations.

10. An arrangement as defined in claim 9, wherein said perforations have straight edges and are formed by slitting and bending out material of the structure.

11. An arrangement as defined in claim 1, including a support fastened to said structure, said support resting against two opposing walls of said duct and being mounted on an upstream side of said structure and inside said concave fold.

12. An arrangement as defined in claim 1, including braces uniting folded surfaces of said structure on the downstream side.

13. An arrangement as defined in claim 1, including a plurality of said structures distributed inside said duct over a plane perpendicular to said main gas stream.

14. An arrangement as defined in claim 1, including a plurality of said structures distributed inside said duct over a plane parallel to said main gas stream.

15. An arrangement as defined in claim 1, including a plurality of said structures distributed inside said duct over at least one plane at an angle to said main gas stream.

16. An arrangement as defined in claim 1, wherein said structure is symmetrical and is folded along a middle line extending along an axis of symmetry, said middle line being at a middle of said three straight lines.

17. An arrangement as defined in claim 1, wherein two outer ones of said three lines that the structure is folded along slope together at an angle bisected by a middle line, said middle line being at a middle of said three straight lines.

18. An arrangement as defined in claim 1, wherein said structure slopes into said duct with downstream edges parallel to a wall of said duct, said downstream edges corresponding to said longer edge.

19. An arrangement as defined in claim 1, wherein said structure slopes into said duct with downstream edges at an acute angle to a wall of said duct, said downstream edges corresponding to said longer edge.

20. A method for reducing nitrogen oxides in flue gas with a reduction agent, comprising: providing at least one flat insertion structure positioned at an acute angle to a main gas stream and having an eddy-generating surface with a freely washed forward edge directed toward oncoming gas and facing partly along and partly across the flowing gas; contouring said structure in cross-section and as substantially a trapezium with two parallel edges of different length; facing the shorter one of said parallel edges upstream and facing the longer edge with an aerodynamic sweep downstream; folding said structure along three straight lines to form an ω or w in cross-section with two convex folds flanking a single concave fold; and injecting said reduction agent into the lee of said structure.

* * * * *